United States Patent [19]

Ali et al.

[11] Patent Number: 4,925,063

[45] Date of Patent: May 15, 1990

[54] CONTAINER HAVING A DUAL PURPOSE CAP AND A DRIPLESS SPOUT

[75] Inventors: Athar M. Ali, 4698 Highway 124, Hoschton, Ga. 30548; Darrell J. Watt; Wendell G. Wilson, both of Atlanta, Ga.

[73] Assignee: Athar Mohammad Ali, Hoschton, Ga.

[21] Appl. No.: 278,669

[22] Filed: Dec. 1, 1988

[51] Int. Cl.[5] ..... B65D 5/74

[52] U.S. Cl. ..... 222/108; 222/153; 222/478; 222/545; 222/551; 222/563; 222/571; 215/216

[58] Field of Search ..... 222/108, 151, 153, 475, 222/478, 544, 545, 546, 548, 549, 551, 562, 563, 566, 571, 539; 215/100.5, 201, 216

[56] References Cited

U.S. PATENT DOCUMENTS

| | | | |
|---|---|---|---|
| 2,308,325 | 1/1943 | Binnington | 222/478 |
| 2,715,480 | 8/1955 | Livingstone | 222/111 |
| 2,742,202 | 4/1956 | Dresden et al. | 222/563 |
| 2,815,155 | 12/1957 | Roche | 222/478 |
| 3,308,998 | 3/1967 | Oppasser et al. | 222/539 |
| 3,367,532 | 2/1968 | Kuwahara | 220/55.1 |
| 3,381,838 | 5/1968 | McLain et al. | 215/228 |
| 3,414,165 | 12/1968 | Goodenow | 222/82 |
| 3,902,621 | 9/1975 | Hidding | 215/216 |
| 4,230,238 | 10/1980 | Wilson | 222/158 |
| 4,298,145 | 11/1981 | Iida | 222/478 |
| 4,475,274 | 10/1984 | Beckstrom et al. | 215/100.5 |
| 4,540,098 | 9/1985 | Luker | 215/216 |
| 4,550,862 | 11/1985 | Barker et al. | 222/109 |
| 4,600,128 | 7/1986 | Rohrer | 222/571 |
| 4,697,722 | 10/1987 | Saito et al. | 222/571 |
| 4,782,964 | 11/1988 | Poore et al. | 215/216 |

FOREIGN PATENT DOCUMENTS

| | | | |
|---|---|---|---|
| 568558 | 11/1957 | Italy | 222/571 |
| 258354 | 4/1964 | Netherlands | 222/111 |
| 97795 | 1/1961 | Norway | 222/563 |
| 103439 | 1/1917 | United Kingdom | 222/478 |
| 477613 | 1/1938 | United Kingdom | 222/571 |

*Primary Examiner*—Michael S. Huppert
*Assistant Examiner*—Steven Reiss
*Attorney, Agent, or Firm*—Hurt, Richardson, Garner, Todd & Cadenhead

[57] ABSTRACT

A container for liquids having a dripless lip assembly incorporated with an angled spout. The container includes various caps for closing the pouring orifice. The caps may include an external retaining plug for sealing and unsealing the pouring orifice quickly. The caps may also include a tamper resistant pull tab. A separate filling orifice is provided.

10 Claims, 2 Drawing Sheets

CONTAINER HAVING A DUAL PURPOSE CAP AND A DRIPLESS SPOUT

BACKGROUND OF THE INVENTION

1. Field of the Invention

This invention relates to a container for holding liquid, and is more particularly concerned with a container having an angled spout for pouring the liquid, which spout includes a dripless lip assembly at its outer end. A cap for covering the orifice of said spout includes threads along its interior side walls and defines a retaining plug along its outer wall. The cap can be threaded over said lip assembly, or alternatively can plug said spout by insertion of the retaining plug into the pouring orifice of the lip assembly. Another embodiment of the present invention includes an alternative spout cap having tamper resistant means, and plug means within its interior, for securing the cap to a dripless lip assembly.

2. Description of the Prior Art

Cooking oils such as olive oil or corn oil, are frequently used while cooking, in a manner such that the oil must be readily available during the cooking process. For example, when foods are fried in a skillet or wok at very high temperatures, the cooking oil must be easily accessible and immediately available, otherwise the product may be overcooked. Various types of containers are used to house the cooking oil. The known commercial containers have one orifice which is used for both filling the container and pouring the oil. Usually, this orifice is at the top of the container and in concentric alignment with the walls of the container. These types of containers with vertically aligned, upwardly extending pouring orifices, sometimes incorporate a dripless lip assembly. The dripless lip assemblies presently known have cylindrical side walls and an annular lip.

It is desireable, however, for the cooking oil container to have a angled spout rather than an upwardly extending, vertically aligned spout, as previously employed. An angled spout permits more control over the pouring of the oil. Dripless lip assemblies previously known, however, do not function optimumly when placed at an angle, such as in an angled spout. Hence, known cooking oil containers which incorporate a dripless lip assembly, align the spout vertically with the container.

Containers utilizing pouring spouts and those which incorporate various assemblies for controlling the flow of liquid from the spout are generally well known in the art. For example, U.S. Pat. No. 2,815,155 discloses a container having a spout designed to discourage drippage during pouring, and to insure that liquid flow through the spout is retarded so that the liquid does not flow too rapidly from the spout. These advantages are accomplished by providing a spout which is tapered at its outer end, which incorporates a bend intermediate its ends, and which has a flared outlet portion that is flattened in a transverse direction. U.S. Pat. No. 3,367,532 also discloses a container having an angled spout, but which further incorporates over its filling orifice, a cap or lid which is designed with waving indentations to prevent its slipping from the container. U.S. Pat. No. 3,414,165 discloses another type of liquid container which incorporates a specially designed spout. The spout extends within the interior of the container to the bottom thereof, in order to prevent ambient air from entering the container and reacting with volatile liquids contained therein. This reference also discloses an internally threaded cap for closing the spout. U.S. Pat. No. 4,230,238 discloses yet another design for a container and spout assembly. This invention is directed to a container having a funnel-like pouring attachment secured to its open top. The attachment includes an apertured face to enable the user to see the contents as they are poured through the spout, and to enable additional ingredients to be poured into the container. The spout is angled to prevent dripping when the container is vertically oriented, but the spout does not include a dripless lip assembly.

U.S. Pat. No. 4,298,145 discloses a device for managing liquid which drips from the spout. In this reference, a spout adapter for containers, especially for cooking oil containers, is provided with an upwardly angled pouring lip in an attempt to reduce dripping somewhat. Further, oil dripping from the pouring lip will flow through the adapter and is channeled back into the container.

U.S. Pat. No. 4,550,862 similarly provides a liquid dispenser which utilizes the combination of a pouring spout received within a drain, which collects liquid dripping from the spout. This reference is also directed to incorporating a drain-back feature to manage the liquid dripping from the spout, and not necessarily directed to preventing drippage from the spout.

The present invention overcomes many of the disadvantages of the containers of the prior art. As disclosed herein a specially designed container incorporates a dripless spout assembly with an angled spout. Further, a dual-purpose cap is disclosed which allows the spout to be readily opened and closed during the cooking process, or alternatively be more securely closed for transportation or storage.

SUMMARY OF THE INVENTION

Briefly described, the present invention includes a container having an upstanding side wall and a bottom wall. The container is for liquid, such as cooking oil, and preferably includes a filling orifice at its top end, and a spout extending from its upper side wall. The spout is angled at approximately 40 degrees to 50 degrees from a vertical axis. Received on the dispensing or pouring end of the spout is a dripless lip assembly, which is specially designed to be incorporated with an angled spout. The assembly comprises a cylindrical side wall and a conical body portion tapering and angling inwardly and terminating at an annular, dripless lip which defines a dispensing orifice. As is well known in the art and not further described herein, protective aluminum seals can be fitted over the filling orifice and the dispensing orifice after the bottle is filled, in order to discourage tampering with its contents.

In one embodiment, internally threaded caps are received over the filling and dispensing orifices. In a second embodiment, a dual-purpose cap seals the pouring orifice. This along the periphery of the dripless lip assembly. The cap also includes a retaining plug integrally molded along its outer surface. The cap can be inverted from its normal threaded engagement, and the retaining plug can be inserted into the pouring orifice to seal the spout. It should be understood that references to sealing or plugging the spout, and to sealing or plugging the pouring or dispensing orifices, are used interchangeably herein. When the container is transported, the cap is threadedly received over the dispensing orifice. When the bottle is being used, however, the retaining plug can be used. This second arrangement allows the user to quickly plug and unplug the dispensing orifice when, for example, the container is used while cooking, as described earlier.

A third embodiment utilizes another cap assembly to seal the spout. In this embodiment, a cylindrical cap having an internal, annular abutment means is fitted over the dripless lip assembly so that the abutment means of the cap abuts a retaining ring on the dripless lip assembly. The cap also includes a pull tab attached to its lower side wall. When the cap is installed, the engagement of the abutment means on the cap and the retaining ring of the dripless lip assembly, secures the cap to the dripless lip assembly. The only way that the cap can be practically removed is to pull the tab, thus separating the lower portion of the cap, which disengages the abutment means from the retaining ring. This feature discourages tampering with the cap. This embodiment of the cap further includes a retaining plug along the interior of its top wall. This plug is received in the pouring orifice to hold the plug in place after the lower portion of the cap is removed. The cap can therefore be easily placed onto and removed from the spout.

Accordingly, it is an object of the present invention to provide a container which is inexpensive to manufacture, durable in structure, and efficient in operation.

Another object of the present invention is to provide a container having an angled spout which incorporates a dripless lip assembly.

Another object of the present invention is to provide a container having a dual purpose cap covering the pouring orifice, so that the cap can be selectively placed in either a transport or a ready-use position.

Another object of the present invention is to provide a container having a tamper resistant cap assembly.

Another object of the present invention is to provide a container which is specially designed to be used to dispense cooking oil or similarly viscous liquid.

Another object of the present invention is to provide a container which is specially designed for efficient use while cooking.

Other objects, features and advantages of the present invention will become apparent from the following description when taken in conjunction with the accompanying drawings, wherein like characters of reference designate corresponding parts throughout the several views.

DESCRIPTION OF THE PREFERRED EMBODIMENTS

Figure 1:
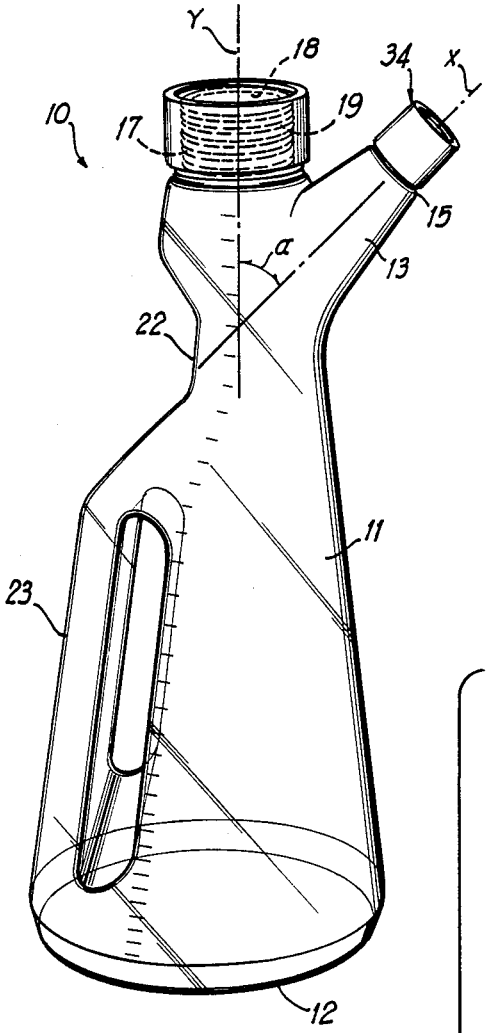
FIG. 1 is an elevational, perspective view of the present invention, utilizing internally threaded orifice caps.

Referring now to the embodiments chosen for the purpose of illustrating the present invention, FIG. 1 depicts a container 10 having curved side wall 11 and flat bottom wall 12. Container 10 is supported in an upright position by wall 12 along vertical axis Y. Container 10 can be made of any suitable material such as glass, but is preferably comprised of relatively flexible, transparent material such as polyethylene, high density polyethylene tercilate (HDPET), high density polyvinyl chloride (HDPVC) or polypropylene. Measuring indicia 9 are marked on the clear side wall 11 of container 10, and may, for example, be delineated in units of fluid ounces and tablespoons. Container 10 also includes angled spout 13, integrally molded with the upper portion of wall 11, as shown in FIG. 1. Spout 13 is tubular in design, and tapers toward a spout orifice 14. Spout 13 terminates at its outer end 15 with annular flange 16, which is integrally formed with spout 13. Spout 13 is angularly disposed as shown in FIG. 1, being essentially concentric with axis X. Spout 13 is preferably formed onto wall 11 so that angle a between axis X and axis Y is approximately 40 to 50 degrees, and ideally is 45 degrees.

The top end 17 of container 10 is preferably cylindrical in design and terminates in a filling orifice 18 (shown in phantom lines). Filling orifice 18 is preferably larger in diameter than that of spout orifice 14, in order to permit container 10 to be readily refilled with liquid. End 17 includes external threads 19 which engage internal threads 20 of cap 21, when cap 21 is threaded onto container 10.

Container 10 preferably has fluted neck 22, which allows container 10 to be readily lifted and tilted for pouring. Further, integral handle 23 is also incorporated during the forming process of container 10, to allow for an alternate means for lifting and tilting.

It is well known in the art that receptacles such as container 10 can be formed by various means, such as blow molding. It is also understood that features of container 10 such as spout 13, threads 19, fluted neck 22 and handle 23 can be integrally formed with wall 11 in the blow molding process.

Figure 2:
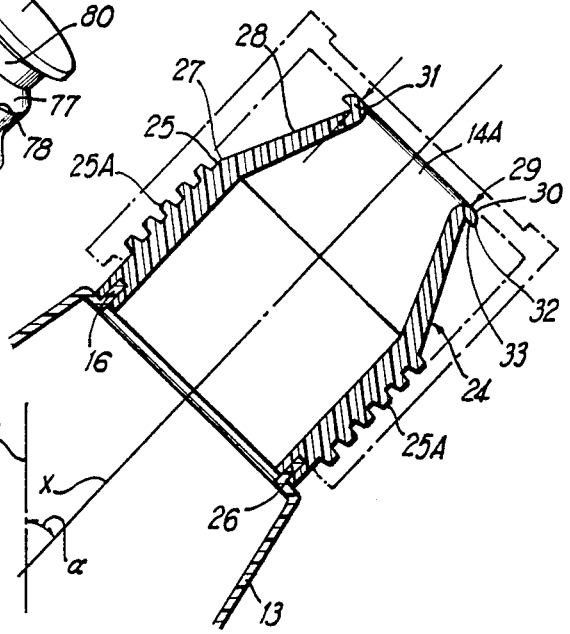
FIG. 2 is a cross-sectional view of the dripless lip assembly, cap and spout.

Mounted unto flange 16 of spout 13 is a frustoconical shaped dripless lip assembly 24. Assembly 24 includes cylindrical lower wall 25 which defines annular channel 26 along its lower edge. The width of channel 26 preferably approximates the thickness of flange 16. Wall 25 includes external threads 25A along its outer periphery. Wall 25 begins tapering at edge 27 to form conical upper wall 28 which terminates at annular collar or lip 29, that defines pouring or dispensing orifice 14A. Lip 29 includes arc-shaped portion 30 having radius 31. Arc-shaped portion 30 terminates at edge 32. Shoulder 33 is then formed in diametric relationship to arc-shaped portion 30, as shown in FIG. 2. Arc-shaped portion 30 is preferably semicircular, having a radius 31 equal to the thickness t of side wall 28. It has been found that 0.04 inch is a preferred value for radius 31 and thickness t. Assembly 24 is made of a material having a low coefficient of friction, such as polyethylene.

Channel 26 of assembly 24 can be securely fixed to spout 13 by, for example, spin welding or other commonly known method, so that there is no leakage between spout 13 and assembly 24.

Figure 4:
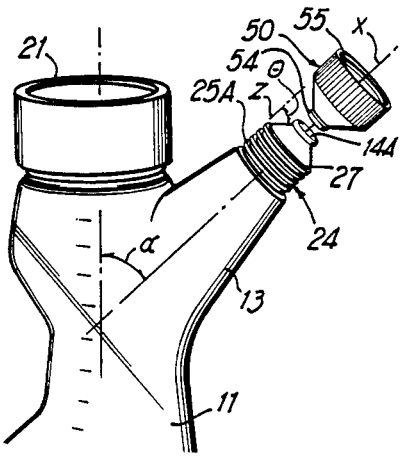
FIG. 4 is a fragmentary view of the embodiment of FIG. 3, depicting the retaining plug of the spout cap in position for insertion into the dispensing orifice.

After assembly 24 is mounted to spout 13, assembly 24 essentially becomes an extension of spout 24 as shown in FIG. 4. For optimum function, dripless lip assembly 24 must be incorporated with the angled spout so that the angle $\theta$ between axis Z, which is parallel to axis X, and the conical side wall 28, plus angle $\alpha$ of the spout, equals approximately 70 to 90 degrees. For example, if the spout is angled at its preferable angle $\alpha$ of 45 degrees, the angle $\theta$ must equal from 25 degrees to 45 degrees in order for assembly 24 to prevent droplets of oil from dripping from lip 29. Ideally, the sum of angles $\alpha$ and $\theta$ equals, but does not exceed, 90 degrees.

In operation, oil is poured by tilting container 10 so that the oil flows through orifice 14A. When container 10 is righted vertically, a quantity of oil will remain momentarily around lip 29. If the assembly is made in accordance with the present invention, the oil on lip 29 will not cross point 32 and drop from lip 29. Instead, because the polyethylene of assembly 24 has a low coefficient of friction, the surface tension of the oil is more apparent. The oil tends to stick to itself rather than the polyethylene lip 29, and will flow back into container 10 rather than drip from lip 29. If the sum of angles $\alpha$ and $\theta$ are less than 70 degrees or more than 90 degrees, the oil is more likely to drip from lip 29. Received over assembly 24 in threaded engagement therewith is internally threaded cap 34, which completes the first embodiment of the present invention.

Figure 3:
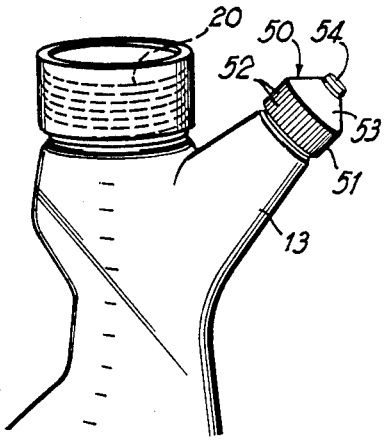
FIG. 3 is a fragmentary view of another embodiment of the present invention, depicting an alternate form of the spout cap covering the dripless lip assembly.

In a second embodiment shown in FIGS. 3 and 4, an alternate cap 50 rather than cap 34, is employed to cover assembly 24. All features of the embodiment previously described are included in this second embodiment, with exception of cap 50. Cap 50 is a frustoconical shaped cap, having cylindrical side wall 51 with friction ridges 52. Extending upwardly from side wall 51 is conical wall 53 which terminates in retaining plug 54. Plug 54 is disk-shaped, having an outer diameter slightly larger than the diameter of orifice 14A. Cap 50 includes internal threads 55 which engage threads 25A of assembly 24, to close orifice 14A, as shown in FIG. 3. Alternatively, cap 50 can be inverted, as depicted in FIG. 4, and installed by inserting plug 54 into the orifice 14A. Using this method for closure of orifice 14A allows cap 54 to be readily installed and removed. This ready-use position is useful when, for example, the container 10 must be tilted while cooking, then recapped quickly.

Figure 5:
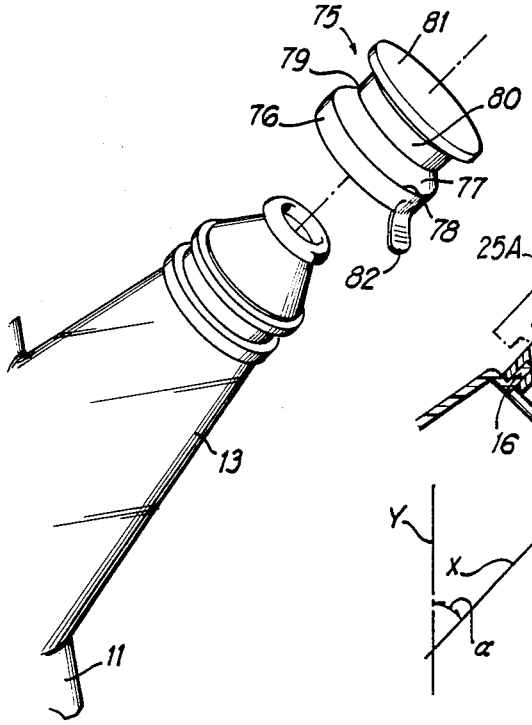
FIG. 5 is a fragmentary view of another embodiment of the present invention, depicting a spout cap which incorporates a pull tab and a dripless lip assembly incorporating a retaining ring.

In a third embodiment, an alternate cap 75 is used to seal dispensing orifice 14A. Cap 75 includes cylindrical side wall 76, and angled side wall 77 which integrally joins wall 76 at abrupt edge 78. Joining wall 77 at edge 79 is cylindrical wall 80 which is concentrically disposed with respect to wall 76. Top wall 81 is joined to wall 80 is shown in FIG. 5. Pull tab 82 joins wall 76, being integrally molded therewith.

Cap 75 includes inner abutment means or annulus 83 along the inner surface of wall 76. Annulus 83 includes upwardly extending, angled surface 84. Annular retaining plug 85 extends downwardly from top wall 81, and includes lip 86 having upwardly angled engaging surface 87. It is well known in the art that cap 75 can be injection molded to integrally include elements 76 through 87.

Dripless lip assembly 88 is identical to assembly 24, except that assembly 88 utilizes retaining ring 89 instead of threads 25A, to secure cap 75 to assembly 88. Retaining ring 89 includes downwardly extending angled surface 90. Cap 75 is initially installed onto assembly 88 by forcing cap 75 over assembly 88 so that surface 90 of retaining ring 89 engages surface 84 of annulus 83. Simultaneously, retaining plug 85 is received into orifice 14A so that upper surface 87 abuts interior conical side wall 91 just below lip 29. Thus cap 75 is securely mounted onto assembly 88, and will be so maintained until surfaces 84 and 90 and surfaces 87 and 91, respectively, are disengaged.

Figure 6:
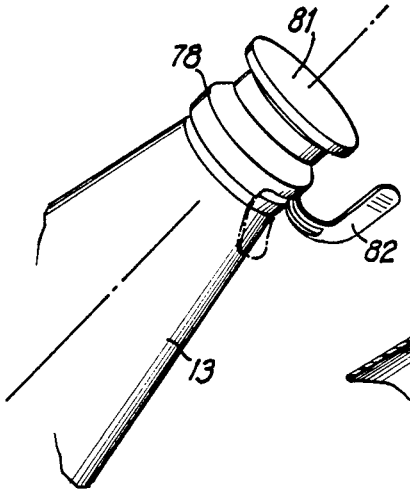
FIG. 6 is a fragmentary view of the embodiment of FIG. 5 depicting a portion of the lower wall of the cap being separated.
Figure 7:
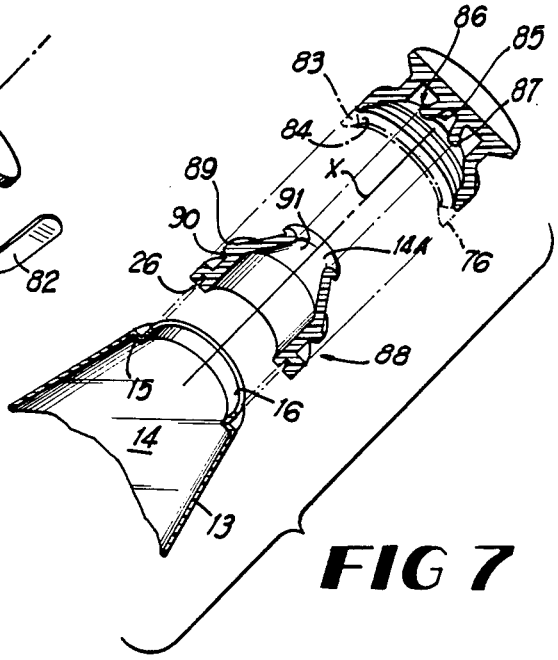
FIG. 7 is a cross-sectional, fragmentary view of the embodiment of FIG. 6, with the bottom portion of the cap removed.

To remove cap 75, tab 82 is pulled in a circular direction around cap 75 as illustrated in FIG. 6. The abrupt edge 78 between side wall 76 and wall 77 causes wall 76 to tear from cap 75 as tab 82 is pulled. Because retaining ring 83 is molded to wall 76, when wall 76 is torn from cap 75, surfaces 84 and 90 are disengaged. Thus, it is readily apparent when cap 75 has been tampered with by removal. Retaining plug 85, therefore, remains as a retaining means to secure cap 75 to assembly 88, as discussed above. Cap 75 can be disengaged from assembly 88 by pulling the cap upwardly to disengage surface 82 of lip 87 from the interior side wall 91 of assembly 88.

It is readily understood by those skilled in the art that such a tamper resistant feature of a tear-away tab can be incorporated into cap 21, which covers filling orifice 18, by the substitution of the above-described features, for the threads of cap 21 and upper end 17.

It will be obvious to those skilled in the art that many variations may be made in the embodiments here chosen for the purpose of illustrating the present invention, and full result may be had to the doctrine of equivalents without departing from the scope of the present invention, as defined by the appended claims.

What is claimed is:

1. A container for liquids, comprising:

(a) an upstanding housing having side walls and a bottom wall, wherein the upper portion of said housing defines a filling orifice;

(b) a tubular spout defining a pouring orifice at one end, whereby said spout is mounted at its other end to the upper side wall of said housing so that the angle between the axis of said tubular spout and the vertical axis of said housing is approximately forty degrees to fifty degrees; and (c) a dripless lip assembly mounted onto said spout at said pouring orifice, said lip assembly having conical side walls tapering to form an annular collar, whereby the angle between the conical side wall and the axis of said spout, plus the angle between the axis of said spout and the vertical axis of said housing equals approximately seventy degrees to ninety degrees.

2. The container defined in claim 1, and a cylindrical first cap removably received onto said housing, whereby said first cap covers said filling orifice.

3. The container defined in claim 2, and a cylindrical second cap removably received onto said spout, whereby said second cap covers said pouring orifice.

4. The container defined in claim 3, said spout defining external threads below said pouring orifice, and said second cap defining threads along its interior side walls for engaging said external threads of said spout.

5. The container defined in claim 2, said housing defining external threads below said filling orifice, and said first cap defining threads along its interior side walls for engaging said external threads of said housing.

6. The container defined in claim 1, whereby said housing defines an integral handle along its side wall, for lifting said container.

7. The container defined in claim 1, and a second cap removably received onto said spout, said second cap defining a retaining plug along its outer surface for being removably received into said pouring orifice.

8. The container defined in claim 1, and a second cap removably received onto said spout, said second cap having a cylindrical side wall, a top wall mounted onto said cylindrical side wall, and a pull tab integral to said side wall and extending outwardly therefrom, whereby a portion of said side wall can be removed by pulling said tab.

9. A container for liquids, comprising:

(a) an upstanding housing having side walls and a bottom wall;

(b) a tubular spout defining a pouring orifice at one end, whereby said spout is mounted at its other end to the upper side wall of said housing;

(c) a dripless lip assembly mounted onto said spout at said pouring orifice, said dripless lip assembly including a conical side wall tapering to define an annular lip having an outer, convex surface; and (d) a cap having side walls and a top wall and a retaining plug along its outer surface, and defining a hollow interior, wherein said cap is mounted over said pouring orifice by the outer end of said spout being received within the interior of said cap, and whereby said retaining plug can be alternatively received into said pouring orifice in order to plug said orifice.

10. A container for liquids, comprising:

(a) an upstanding housing having side walls and a bottom wall;

(b) a tubular spout defining a pouring orifice at one end, whereby said spout is mounted at its other end to the upper side wall of said housing so that the angle between the axis of said tubular spout and the vertical axis of said housing is approximately forty degrees to fifty degrees; and (c) a dripless lip assembly mounted onto said spout at said pouring orifice, said lip assembly having conical side walls tapering to form an annular collar, whereby the angle between the conical side wall and the axis of said spout, plus the angle between the axis of said spout and the vertical axis of said housing equals approximately seventy degrees to ninety degrees.

* * * * *